US008282187B2

(12) United States Patent
Iwanaga

(10) Patent No.: US 8,282,187 B2
(45) Date of Patent: Oct. 9, 2012

(54) LIQUID DISCHARGING APPARATUS

(75) Inventor: Tsutomu Iwanaga, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 327 days.

(21) Appl. No.: 12/364,062

(22) Filed: Feb. 2, 2009

(65) Prior Publication Data

US 2009/0195593 A1 Aug. 6, 2009

(30) Foreign Application Priority Data

Feb. 4, 2008 (JP) ..... 2008-023549

(51) Int. Cl.
*B41J 2/165* (2006.01)

(52) U.S. Cl. ..... 347/29

(58) Field of Classification Search ..... None
See application file for complete search history.

(56) References Cited

U.S. PATENT DOCUMENTS

| | | | | |
|---|---|---|---|---|
| 4,893,137 | A | 1/1990 | Ebinuma et al. | |
| 5,467,114 | A | 11/1995 | Ebinuma et al. | |
| 5,552,812 | A | 9/1996 | Ebinuma et al. | |
| 5,742,303 | A * | 4/1998 | Taylor et al. | 347/36 |
| 5,760,802 | A | 6/1998 | Ebinuma et al. | |
| 6,474,774 | B1 | 11/2002 | Okamoto | |

FOREIGN PATENT DOCUMENTS

| | | | |
|---|---|---|---|
| JP | 63-160849 | A | 7/1988 |
| JP | 05-116330 | | 5/1993 |
| JP | 05-116330 | A | 5/1993 |
| JP | 11-291509 | A | 10/1999 |
| JP | 2001-162816 | A | 6/2001 |
| JP | 2006-007455 | | 1/2006 |
| JP | 2006-007455 | A | 1/2006 |

* cited by examiner

*Primary Examiner* — Matthew Luu
*Assistant Examiner* — Alejandro Valencia
(74) *Attorney, Agent, or Firm* — Maschoff Gilmore & Israelsen

(57) ABSTRACT

A liquid discharging apparatus discharges liquid onto a target, thereby forming dots. The apparatus includes a discharge head, a capping unit for moisturizing, a lifting and lowering unit, and a lid member. The discharge head has a discharge surface from which liquid is discharged. The capping unit is disposed substantially just below the discharge head when the discharge head is located at a predetermined reference position. The capping unit has an opening that comes into contact with the discharge head and seals the discharge surface. The lifting and lowering unit lifts and lowers the capping unit, thereby bringing the capping unit into contact with the discharge head and taking the capping unit out of contact with the discharge head. The lid member rotates around a rotating shaft using the lifting and lowering of the capping unit, thereby opening and closing the opening of the capping unit.

7 Claims, 8 Drawing Sheets

LIQUID DISCHARGING APPARATUS

BACKGROUND

1. Technical Field

The present invention relates to a liquid discharging apparatus that discharges liquid onto a target, thereby forming dots.

2. Related Art

There has been proposed this kind of liquid discharging apparatus in which discharge ports of a head is capped with a moisturizing cap when printing is not performed (for example, JP-A-2006-7455). In this apparatus, by capping the discharge ports of the head with the moisturizing cap, ink in the discharge ports can be prevented from thickening, and the occurrence of defective printing can be reduced.

In the above type of liquid discharging apparatus, in order to maintain the discharge ports of the head moist with the cap, it is preferable to moisturize the inside of the cap. In this case, it is possible to store waste liquid obtained when cleaning is performed in which ink is sucked out of the discharge ports with a suction pump to prevent the discharge ports from clogging, in a tank and to moisturize the inside of the cap using the waste liquid in the tank. However, a space to dispose the tank is necessary, and so the apparatus increases in size. It is also possible to discharge ink droplets into the cap for moisturizing the inside of the cap when the head is capped with the cap. However, wasteful consumption of ink increases.

SUMMARY

An advantage of some aspects of the invention is to provide a liquid discharging apparatus in which moisturizing can be more appropriately performed when a discharge head is capped.

In an aspect of the invention, a liquid discharging apparatus discharges liquid onto a target, thereby forming dots. The apparatus includes a discharge head, a capping unit for moisturizing, a lifting and lowering unit, and a lid member. The discharge head is capable of scanning and has a discharge surface from which liquid is discharged. The capping unit is disposed substantially just below the discharge head when the discharge head is located at a predetermined reference position. The capping unit has an opening capable of coming into contact with the discharge head and of sealing the discharge surface. The lifting and lowering unit lifts and lowers the capping unit, thereby bringing the capping unit into contact with the discharge head and taking the capping unit out of contact with the discharge head. The lid member has a rotating shaft and rotates around the rotating shaft using the lifting and lowering of the capping unit by the lifting and lowering unit, thereby opening and closing the opening of the capping unit.

The liquid discharging apparatus has the lid member that rotates around the rotating shaft using the lifting and lowering of the capping unit capable of coming into contact with the discharge head and of sealing the discharge surface, thereby opening and closing the opening of the capping unit. Therefore, the inside of the capping unit can be maintained moist while the discharge head is performing discharge. As a result, the need to perform moisturizing discharge into the capping unit can be reduced, and the discharge head can be more appropriately maintained moist when capped with the capping unit. In addition, the lid member opens and closes using the lifting and lowering of the capping unit by the lifting and lowering unit that brings the capping unit into contact with the discharge head and takes the capping unit out of contact with the discharge head. Therefore, the apparatus can be prevented from increasing in size compared to separately disposing a power source for opening and closing the lid member.

It is preferable that when the capping unit is lifted to a predetermined opening position lower than the lower surface of the discharge head, the lid member be pushed up by the capping unit and open the opening, and when the capping unit is lowered to a predetermined closing position, the lid member close the opening by its own weight. It is also preferable that the lid member have an urging unit that urges the lid member to close the opening of the capping unit, that when the capping unit is lifted to a predetermined opening position lower than the lower surface of the discharge head, the lid member be pushed up by the capping unit and open the opening, and that when the capping unit is lowered to a predetermined closing position, the lid member close the opening by the urging force of the urging unit. In these cases, the opening can be opened and closed by a simple configuration using the lifting and lowering of the capping unit. In the latter case, the opening can be more reliably closed using the urging unit. The term "predetermined opening position" means a position at which the capping unit needs to be located in order to push up the lid member and to open the opening without interfering with the scanning of the discharge head. The capping unit can be lifted to the predetermined opening position, for example, before the discharge head is moved to the reference position and the discharge surface is sealed with the opening. The term "predetermined closing position" means a position at which the capping unit needs to be located in order for the lid member to close the opening. The capping unit can be lowered to the predetermined closing position, for example, when the discharge surface of the discharge head is made unsealed. The term "urging unit" include a spring. It is preferable that when an instruction to form dots on the target is issued, the capping unit be lowered to the predetermined closing position and then the discharge head start scanning and discharging, and that when the formation of dots on the target is finished, the discharge head stand by at a predetermined standby position different from the predetermined reference position, and the capping unit be lifted to the predetermined opening position, and then the discharge head be moved to the predetermined reference position, and the capping unit be lifted so as to come into contact with the discharge head. In this case, the opening of the capping unit can be smoothly opened and closed. It is preferable that when the formation of dots on the target is finished, the discharge head stand by at the predetermined standby position, and the capping unit be lifted to the predetermined opening position, thereby partly opening the opening, and then the discharge head be moved to the predetermined reference position, thereby completely opening the opening. In this case, the opening can be opened using the discharge head. It is preferable that when the discharge head is located at the predetermined reference position while opening the opening, the lid member lean against the discharge head and be supported by the discharge head. In this case, there is no need to separately provide a mechanism for maintaining the opening open.

It is preferable that the capping unit have a suction unit that sucks and removes liquid in the discharge head with the discharge surface of the discharge head sealed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
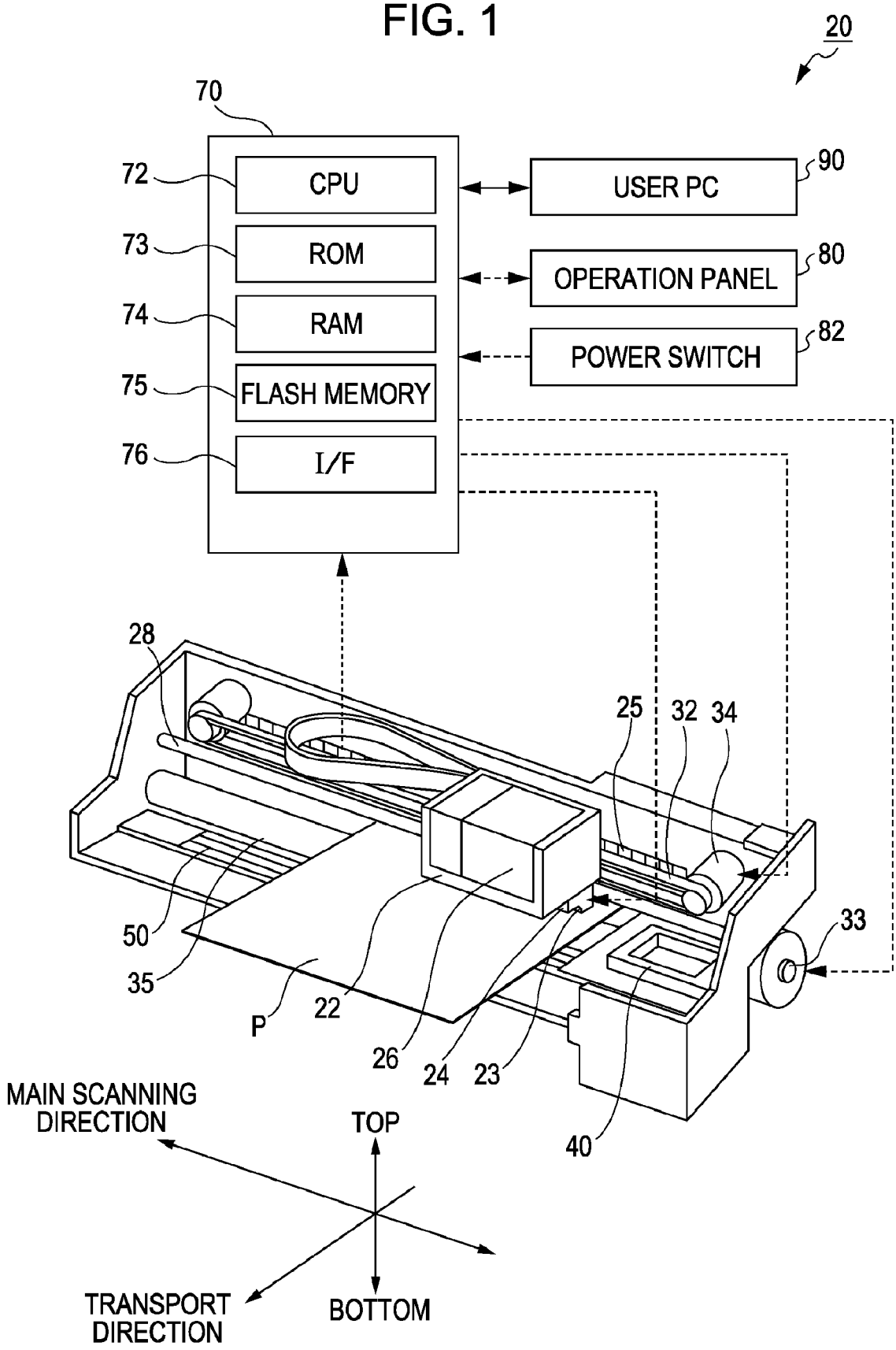
FIG. 1 schematically shows the configuration of an ink jet printer 20.
Figure 2:
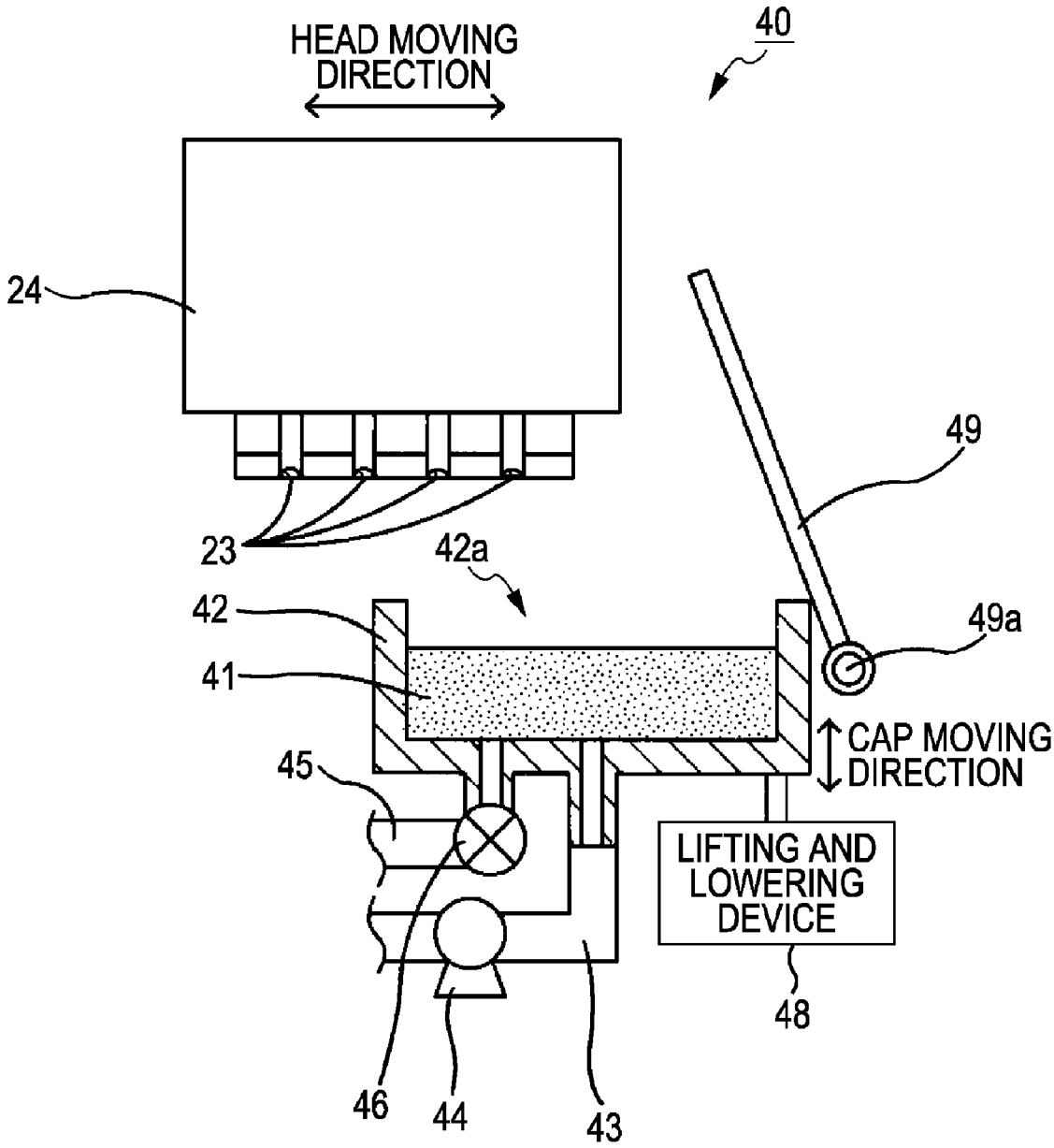
FIG. 2 schematically shows the configuration of a capping device 40.
Figure 3:
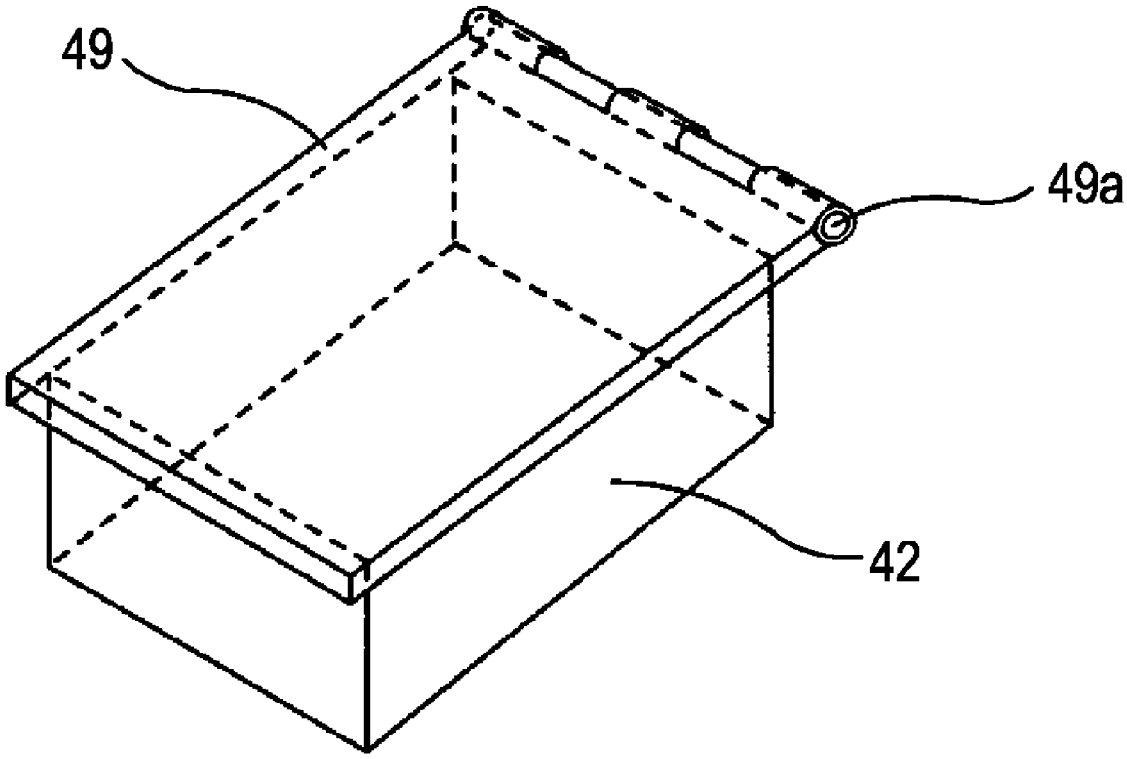
FIG. 3 is an external perspective view of a cap 42.

Next, the embodiment of the invention will now be described with reference to the drawings. FIG. 1 schematically shows the configuration of an ink jet printer 20 that is an embodiment of a liquid discharging apparatus of the invention. FIG. 2 schematically shows the configuration of a capping device 40. FIG. 3 is an external perspective view of a cap 42.

As shown in FIG. 1, the ink jet printer 20 of the invention has a paper feed roller 35, a carriage 22, ink cartridges 26, a print head 24, a capping device 40, a controller 70, and an operation panel 80. The paper feed roller 35 is driven by a drive motor 33 and transports paper P across a platen 50 from the back to the front in the figure. The carriage 22 is attached to a carriage belt 32, and it is driven by a carriage motor 34 and reciprocates along a guide 28 in a horizontal direction (main scanning direction). The ink cartridges 26 are mounted on the carriage 22 and separately contain yellow (Y), magenta (M) cyan (C), and black (K) inks. The print head 24 has nozzles 23 that pressurize ink supplied from the ink cartridges 26 and discharge ink droplets. The capping device 40 is disposed near the right end of the platen 50 and seals a surface of the print head 24 where the nozzles 23 are formed (hereinafter referred to as nozzle forming surface), and as needed it sucks ink in the nozzles 23, thereby performing cleaning. The controller 70 controls the whole apparatus. The user inputs various instructions using the operation panel 80, and the operation panel 80 provides the user with various information. Behind the carriage 22 is disposed a linear encoder 25 that detects the position of the carriage 22. The position of the carriage 22 is controlled using the linear encoder 25. The print head 24 may pressurize ink by deforming a piezoelectric element by applying a voltage thereto. Alternatively, it may pressurize ink by generating an air bubble by heating ink by applying a voltage to a heating resistor (for example, a heater).

As shown in FIG. 2 or 3, the capping device 40 has a cap 42, a suction pump 44, an atmospheric relief valve 46, a lifting and lowering device 48, and a lid 49. The cap 42 is a substantially rectangular solid and has an opening 42*a* at the top thereof. Inside the cap 42 is disposed a sponge 41 serving as an ink absorber for absorbing ink. The suction pump 44 is attached to a flexible tube 43 connected to the bottom of the cap 42. The atmospheric relief valve 46 is attached to a flexible tube 45 connected to the bottom of the cap 42. The lifting and lowering device 48 lifts and lowers the cap 42 for bringing the cap 42 into contact with the print head 24 and taking the cap 42 out of contact with the print head 24. The lid 49 opens and closes the opening 42*a* of the cap 42. The capping device 40 is used for sealing the nozzle forming surface, cleaning, and flushing. When printing is not performed, the print head 24 is located at a position over the capping device 40 (hereinafter referred to as home position), and the nozzle forming surface is sealed to prevent the ink in the nozzles 23 from thickening (drying). Cleaning is the operation of forcing ink out of the nozzles 23 at a predetermined time by sealing the nozzle forming surface, closing the atmospheric relief valve 46, driving the suction pump 44, and thereby having an internal space defined by the print head 24 and the cap 42 under a negative pressure. Flushing is the operation of discharging ink at a predetermined time independently of print data. Part of ink sucked by the cleaning and ink discharged by the flushing are absorbed by the sponge 41 in the cap 42.

Figure 4A:
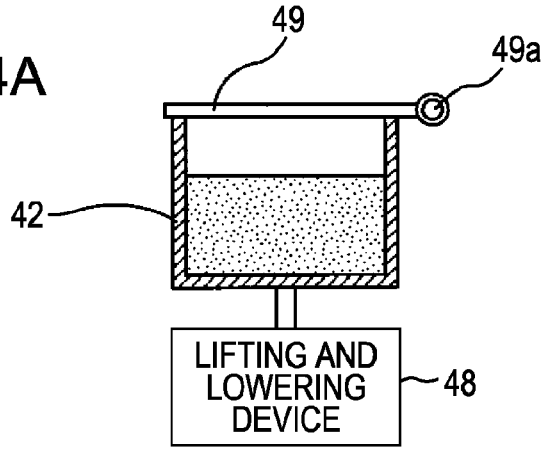
FIGS. 4A to 4C show the opening and closing of the opening 42*a* by the lid 49.
Figure 4B:
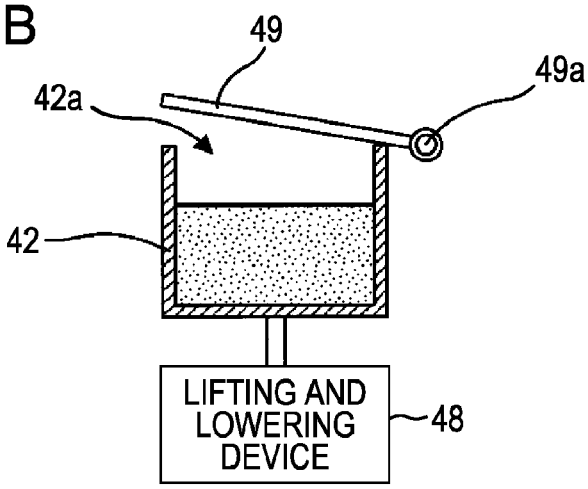
Figure 4C:
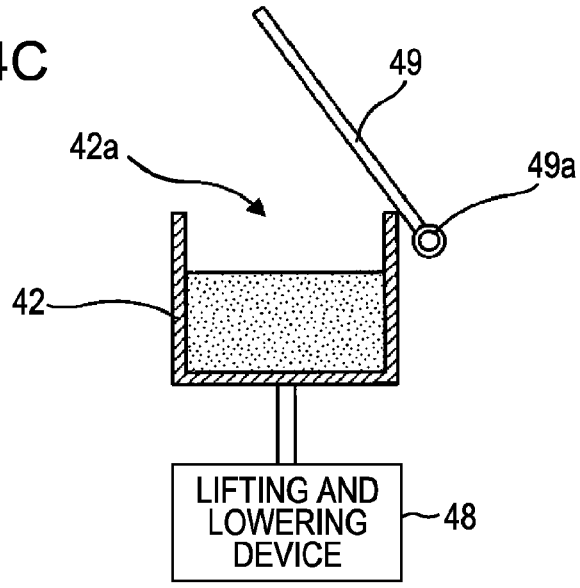

The lid 49 rotates around a rotating shaft 49*a* in conjunction with the lifting and lowering of the cap 42 by the lifting and lowering device 48, thereby opening and closing the opening 42*a* of the cap 42. FIGS. 4A to 4C show the opening and closing of the opening 42*a* by the lid 49. As shown, when the cap 42 is located at the lowermost position, the opening 42*a* of the cap 42 is closed (see FIG. 4A). When the lifting and lowering device 48 lifts the cap 42, the right edge in the figure of the opening 42*a* of the cap 42 pushes up the lid 49, and the opening 42*a* is opened (see FIGS. 4B and 4C). When the lifting and lowering device 48 lowers the cap 42, the lid 49 is lowered by its own weight, and the cap 42 is closed.

The controller 70 is configured as a microprocessor centered around a CPU 72, and it has a ROM 73 that stores processing programs, a RAM 74 that temporarily stores data, a flash memory 75 into which data can be written and from which data can be erased, an interface (I/F) 76 that exchanges information with external devices, and input and output ports (not shown). A position detection signal from the linear encoder 25, an operation signal from the operation panel 80, an on/off signal from the power switch 82, and so forth are input into the controller 70 through the input port (not shown). In addition, a print job and so forth are input into the controller 70 from a user PC 90 through the I/F 76. A control signal to the print head 24, a control signal to the drive motor 33, a control signal to the carriage motor 34, a control signal to the lifting and lowering device 48, a display command signal to the operation panel 80, and so forth are output from the controller 70 through the output port (not shown). In addition, print status information is output from the controller 70 through the I/F 76 to the user PC 90.

Figure 5:
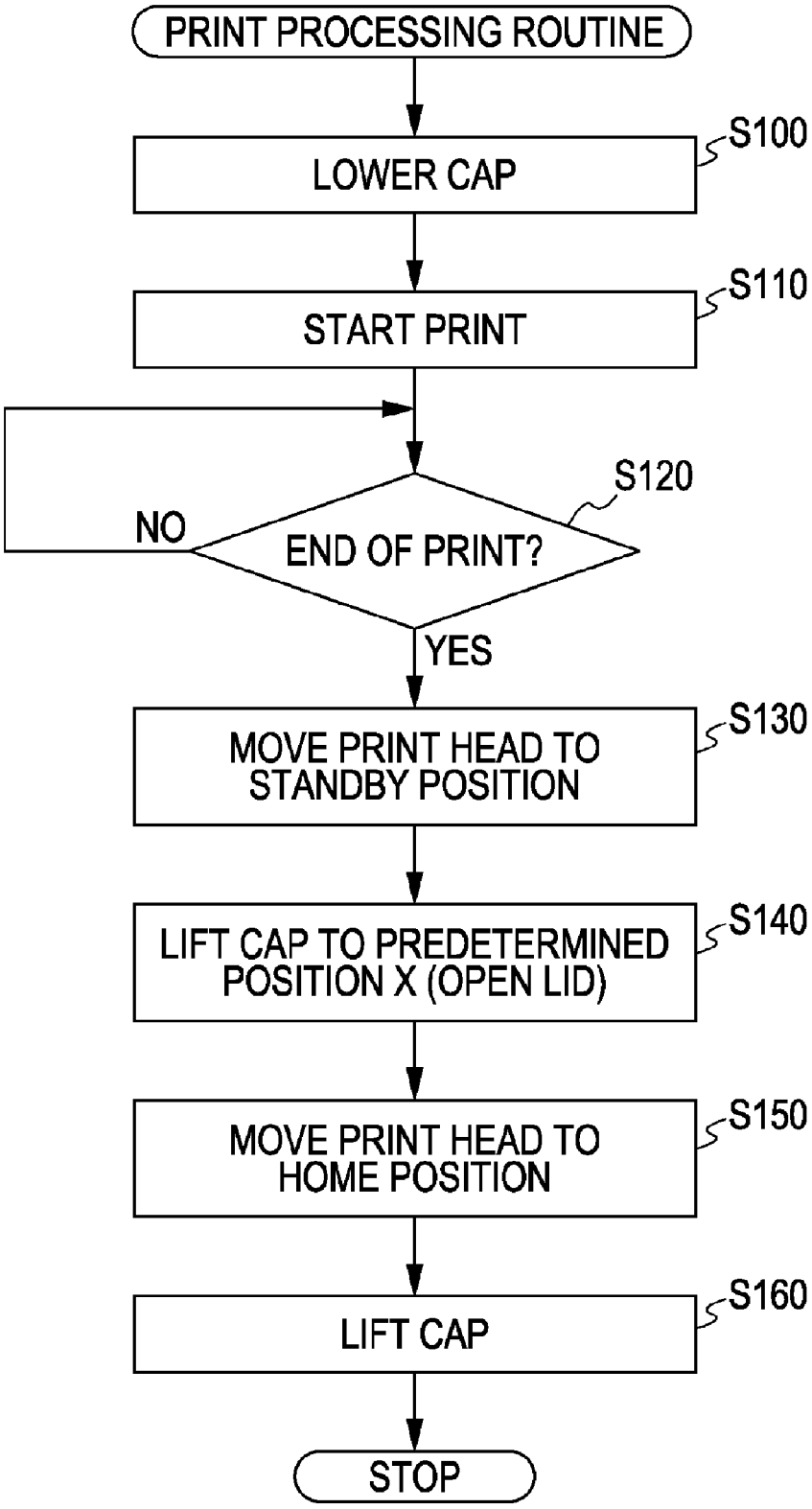
FIG. 5 is a flowchart showing an example of a print processing routine.
Figure 6A:
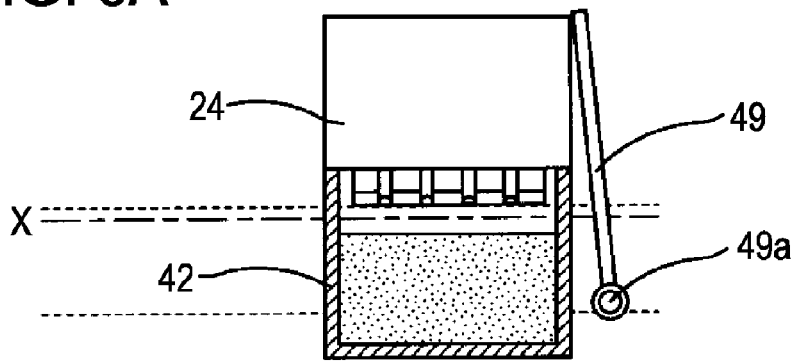
FIGS. 6A to 6C show the movement of the cap 42 and the lid 49 before the start of printing.
Figure 6B:
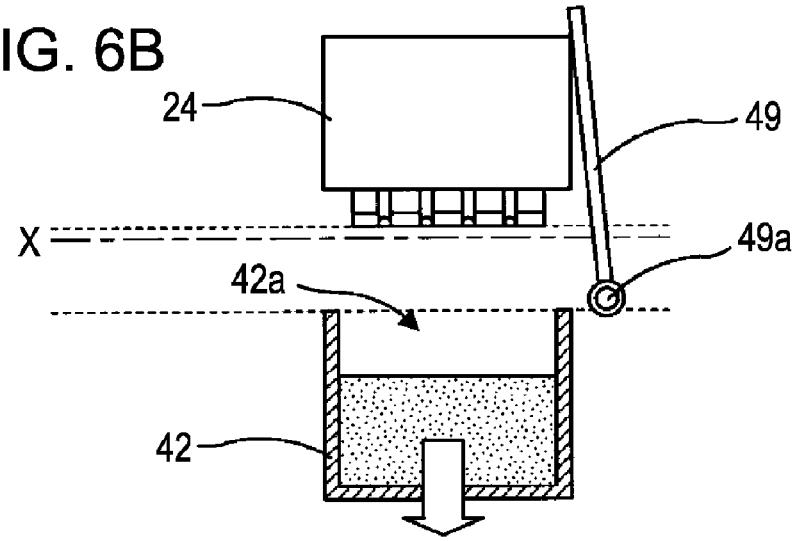
Figure 6C:
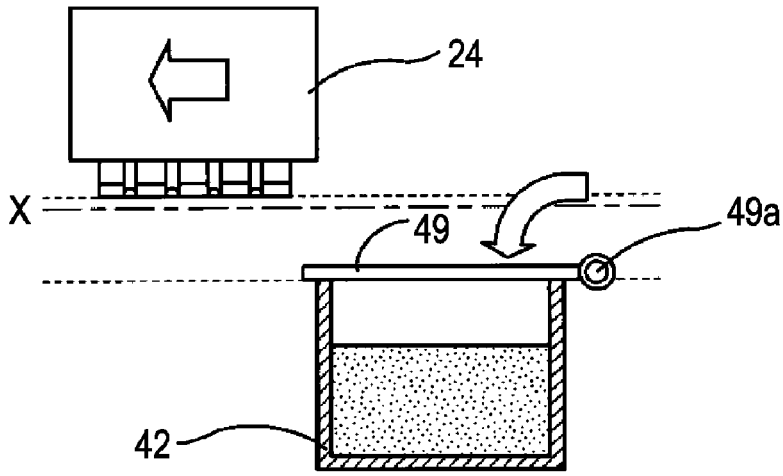
Figure 7A:
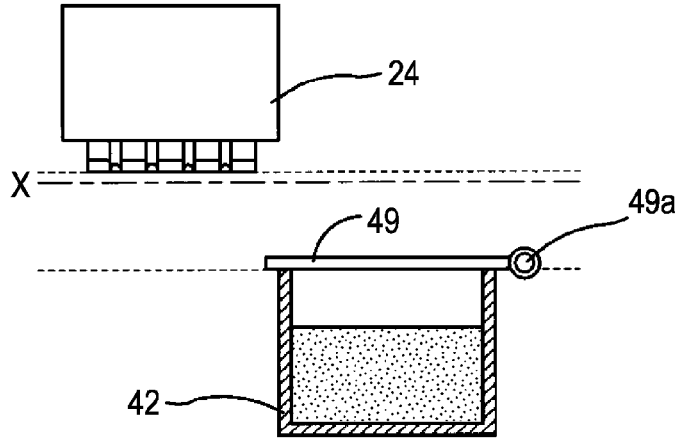
FIGS. 7A to 7D show the movement of the cap 42 and the lid 49 after the end of printing.
Figure 7B:
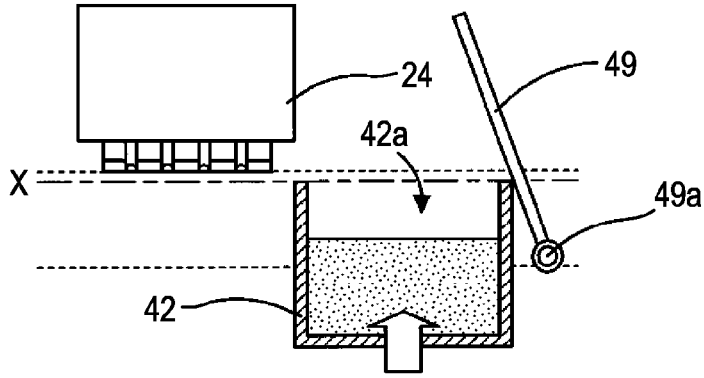
Figure 7C:
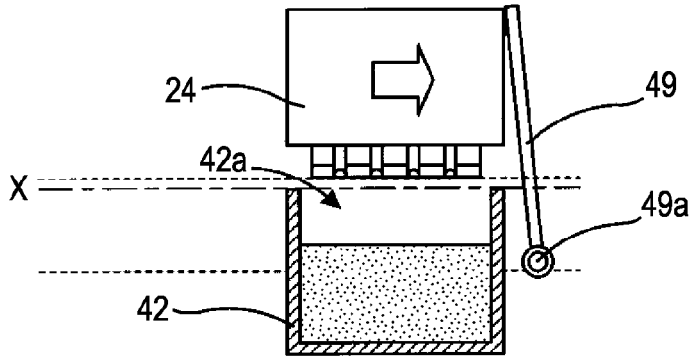
Figure 7D:
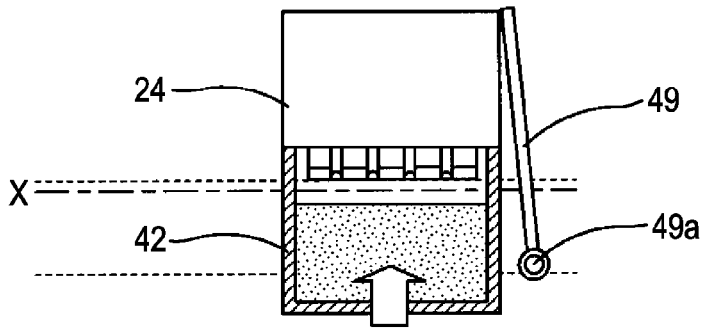

The operation of the ink jet printer 20 of the embodiment thus configured will be described. FIG. 5 is a flowchart showing an example of a print processing routine executed by the CPU 72 of the controller 70. This routine is executed when a print job is input from the user PC 90. FIGS. 6A to 6C and 7A to 7D show the movement of the cap 42 and the lid 49 that accompanies the execution of this print processing routine. FIGS. 6A to 6C show the movement before the start of printing, and FIGS. 7A to 7D show the movement after the end of printing. Hereinafter, the print processing routine of FIG. 5 will be described with reference to FIGS. 6A to 6C and 7A to 7D. In the initial state, the cap 42 is fitted over the print head 24 and sealing the nozzle forming surface (see FIG. 6A). In this state, the lid 49 leans against the print head 24 and is supported by the print head 24.

When the print processing routine is executed, the CPU 72 of the controller 70 first controls the lifting and lowering device 48 so that the cap 42 lowers to the lowermost position (step S100). The cap 42 sealing the nozzle forming surface of the print head 24 is thereby removed, but the lid 49 remains leaning against the print head 24 located at the home position (see FIG. 6B). Next, on the basis of the print job, print data is made and print processing is started (step S110). Specifically, print processing is performed by controlling the drive motor 33 so that paper P is transported by the transport roller 35 in the sub-scanning direction and controlling the carriage motor 34 and the print head 24 so that ink is discharged from the nozzles 23 of the print head 24 moving in the main scanning direction. With the movement of the print head 24 away from the home position, the lid 49 is rotated by its own weight around the rotating shaft 49*a* and closes the opening 42*a* of the cap 42 (see FIG. 6C). Therefore, moisture in the internal space in the cap 42 does not evaporate, and the internal space is maintained moist.

After the end of printing, the carriage motor 34 is controlled so that the print head 24 stands by at a standby position to the left of the home position (see FIG. 7A) (step S130), and the lifting and lowering device 48 is controlled so that the cap 42 rises to a predetermined position X (step S140). When the cap 42 is located at the predetermined position X, the upper surface of the cap 42 is lower than the nozzle forming surface of the print head 24, and the lid 49 is pushed up at a predetermined angle by the cap 42. Since the print head 24 stands by at the standby position as described above, the print head 24 does not interfere with the opening of the lid 49 (see FIG. 7B). Next, the carriage motor 34 is controlled so that the print head 24 moves to the home position (step S150). The print head 24 moving to the home position rotates the lid 49 pushed up at the predetermined angle so that the opening 42*a* is completely opened (see FIG. 7C). After the opening 42*a* is completely opened, the lifting and lowering device 48 is controlled so that the cap 42 rises to a position where the cap 42 is fitted over the print head 24 and seals the nozzle forming surface (step S160), and the routine is ended. Thus, the nozzle forming surface of the print head 24 is sealed by the cap 42 (see FIG. 7D). As described above, during printing, the opening 42*a* of the cap 42 is closed by the lid 49, and the internal space in the cap 42 is maintained moist. Therefore, when the nozzle forming surface of the print head 24 is sealed with the cap 42, ink in the nozzles 23 can be more reliably prevented from thickening (drying).

The correspondence relationship between components of the embodiment and components of the invention will be clarified. The print head 24 of the embodiment corresponds to a discharge head of the invention. The capping device 40 corresponds to a capping unit. The lifting and lowering device 48 corresponds to a lifting and lowering unit. The lid 49 corresponds to a lid member.

As described above, the ink jet printer 20 of the embodiment has the lid 49 that closes the opening 42*a* of the cap 42 while the print head 24 is performing scanning and printing. Therefore, moisture in the cap 42 can be prevented from evaporating during printing. As a result, when printing is finished and the nozzle forming surface of the print head 24 is sealed with the cap 42, without discharging ink for moisturizing from the nozzles 23, an excellently moist condition can be maintained, and ink in the nozzles 23 can be more reliably prevented from thickening (drying). In addition, the rotating shaft 49*a* is disposed so that the lifting and lowering of the cap 42 by the lifting and lowering device 48 opens and closes the opening 42*a*, and the lid 49 rotates around the rotating shaft 49*a*. Therefore, the opening 42*a* of the cap 42 can be opened and closed by a simple configuration, and the whole apparatus can be compact compared to using a power source such as a motor to open and close the lid 49.

In the embodiment, the lid 49 is opened by lifting the cap 42 and moving the print head 24 to the home position. However, the lid 49 may be opened only by lifting the cap 42.

Figure 8A:
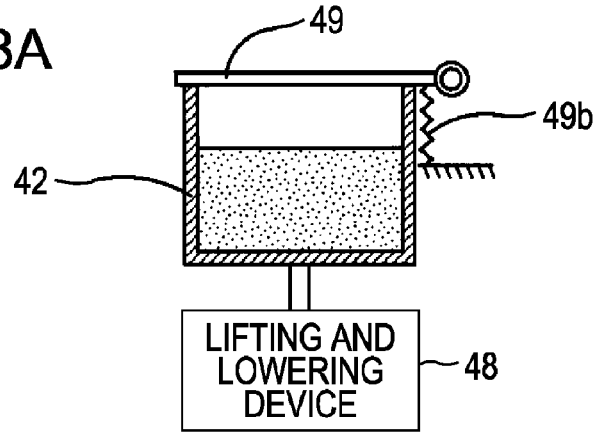
FIGS. 8A to 8C show the opening and closing of the opening 42*a* by the lid 49.
Figure 8B:
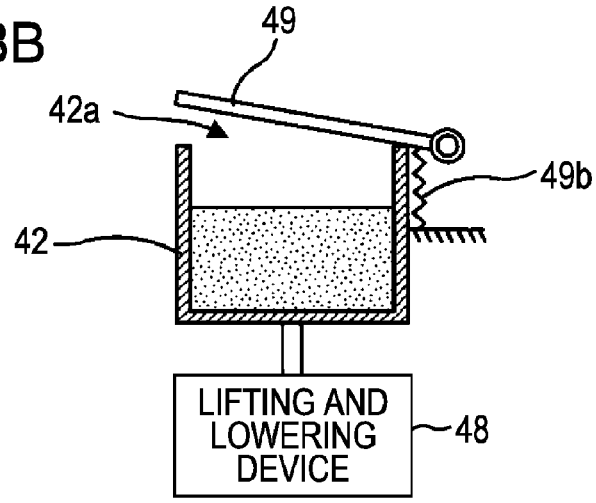
Figure 8C:
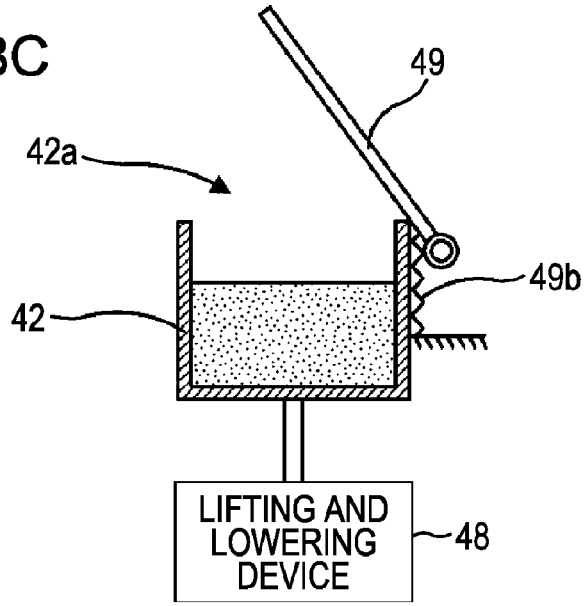

In the embodiment, when the cap 42 is lowered by the lifting and lowering device 48, the lid 49 is lowered by its own weight and closes the opening 42*a* of the cap 42. Alternatively, the lid 49*b* may be provided with an urging member. For example, as shown in FIGS. 8A to 8C, a spring 49*b* may be provided so that the lid 49 is urged to close the opening 42*a* of the cap 42. When the cap 42 is lowered, the lid 49 is lowered by the spring 49*b* and closes the opening 42*a* of the cap 42.

In the embodiment, when printing is finished, the print head 24 stands by at the standby position, and the cap 42 is lifted to the predetermined position X by the lifting and lowering device 48 so as to open the opening 42*a*. However, the cap 42 may be lifted to the predetermined position X so as to open the opening 42*a* at a time shortly before the end of printing. In this case, depending on the time, the print head 24 need not stand by at the standby position.

In the embodiment, flushing, the operation of discharging ink at a predetermined time independently of print data, is performed in the capping device 40. However, a region in which flushing is performed may be formed separately from the capping device 40.

In the embodiment, the liquid discharging apparatus of the invention is embodied in a printer. However, it can be applied to any apparatus that discharges liquid onto a target. It may be embodied, for example, in a fluid discharging apparatus that discharges a liquid other than ink, a liquid in which particles of a functional material are dispersed (dispersion liquid), or a fluid such as a gel. It may also be embodied, for example, in a liquid discharging apparatus that discharges a liquid in which a material such as an electrode material or a color material used for manufacturing liquid crystal displays, EL (electroluminescence) displays, and field emission displays is dissolved, a fluid discharging apparatuses that discharges a fluid in which the same material is dispersed, or a liquid discharging apparatus that is used as a precise pipette and discharges a sample liquid. In addition, it may also be embodied in a liquid discharging apparatus that discharges a transparent resin liquid such as an ultraviolet curable resin onto a substrate to form a micro hemispherical lens (optical lens) used in an optical communication element, a liquid discharging apparatus that discharges an etching liquid such as an acid or alkali to etch a substrate, and a fluid discharging apparatus that discharges a gel.

In the above-described embodiment, the invention is embodied in a printer having only a printing function. However, the invention may be embodied in a multifunction printer having a scanner function, or a facsimile.

Although the embodiment of the invention has been described, it goes without saying that the invention is not limited to the above-described embodiment and can be carried out in various ways without departing from the technical scope of the invention.

What is claimed is:

1. A liquid discharging apparatus that discharge liquid onto a target, thereby forming dots, the apparatus comprising:

a discharge head that is capable of scanning and that has a discharge surface from which liquid is discharged;

a capping unit for moisturizing that is disposed substantially just below the discharge head when the discharge head is located at a predetermined reference position and that has an opening capable of coming into contact with the discharge in a capping position;

a lifting and lowering unit that lifts and lowers the capping unit between a capping thereby bringing the capping unit into contact with the position and a standby position, discharge head and taking the capping unit out of contact with the discharge head; and a lid member that has a rotating shaft and that rotates around the rotating shaft using the lifting and lowering of the capping unit by the lifting and lowering unit, thereby opening and closing the opening of the capping unit, wherein the rotating shaft is disposed above the opening of the capping unit in the standby position and below the opening of the capping unit in the capping position, wherein when the lifting and lowering unit lifts the capping unit, the lid member rotates around the rotating shaft solely due to a lifting force of the capping unit which is applied to the lid member when the capping unit comes into contact with the lid member opening the opening of the capping unit, and wherein when the capping unit is lowered from the capping position, the lid member rotates around the rotating shaft solely due to the weight of the lid member so as to close the opening of the capping unit.

2. The liquid discharging apparatus according to claim 1, wherein the lid member has an urging unit that urges the lid member to close the opening of the capping unit, wherein when the capping unit is lifted to a predetermined opening position lower than the lower surface of the discharge head, the lid member is pushed up by the capping unit and opens the opening, and wherein when the capping unit is lowered to a predetermined closing position, the lid member closes the opening by the urging force of the urging unit.

3. The liquid discharging apparatus according to claim 2, wherein the urging unit is a spring.

4. The liquid discharging apparatus according to claim 1, wherein when an instruction to form dots on the target is issued, the capping unit is lowered to the predetermined closing position and then the discharge head starts scanning and discharging, and wherein when the formation of dots on the target is finished, the discharge head stands by at a predetermined standby position different from the predetermined reference position, and the capping unit is lifted to the predetermined opening position, and then the discharge head is moved to the predetermined reference position, and the capping unit is lifted so as to come into contact with the discharge head.

5. The liquid discharging apparatus according to claim 4, wherein when the formation of dots on the target is finished, the discharge head stands by at the predetermined standby position, and the capping unit is lifted to the predetermined opening position, thereby partly opening the opening, and then the discharge head is moved to the predetermined reference position, thereby completely opening the opening.

6. The liquid discharging apparatus according to claim 5, wherein when the discharge head is located at the predetermined reference position while opening the opening, the lid member leans against the discharge head and is supported by the discharge head.

7. The liquid discharging apparatus according to claim 1, wherein the capping unit has a suction unit that sucks and removes liquid in the discharge head with the discharge surface of the discharge head sealed.

* * * * *